United States Patent [19]

Brink

[11] 4,076,579

[45] Feb. 28, 1978

[54] PULPING OF LIGNOCELLULOSIC MATERIAL BY SEQUENTIAL TREATMENT THEREOF WITH NITRIC OXIDE AND OXYGEN

[75] Inventor: David L. Brink, Berkeley, Calif.

[73] Assignee: The Regents of the University of California, Berkeley, Calif.

[21] Appl. No.: 565,524

[22] Filed: Apr. 7, 1975

Related U.S. Application Data

[63] Continuation-in-part of Ser. No. 385,878, Aug. 6, 1973, abandoned, which is a continuation-in-part of Ser. No. 149,589, Jun. 3, 1971, abandoned.

[51] Int. Cl.[2] ..... D21C 3/16; D21C 3/26

[52] U.S. Cl. ..... 162/53; 8/156; 162/60; 162/63; 162/65; 162/81; 162/90

[58] Field of Search ..... 162/81, 65, 90, 53, 162/56, 89, 66, 60, 63; 8/156

[56] References Cited

U.S. PATENT DOCUMENTS

| | | | |
|---|---|---|---|
| 2,360,779 | 10/1944 | Lang et al. | 162/60 X |
| 2,733,992 | 2/1956 | Reyerson | 162/63 X |

*Primary Examiner*—Arthur L. Corbin

*Attorney, Agent, or Firm*—Edward B. Gregg; Stanley Bialos

[57] ABSTRACT

Particulate lignocellulosic material, having a moisture content of about 10–80 weight percent, is treated at temperatures below about 50° C. with 2 to 8 weight percent nitric oxide based on the weight of dry lignocellulosic material. Thereafter, said nitric oxide treated material is reacted with molecular oxygen to form nitric acid in situ. This reaction is followed by washing of said material with alkali and extraction of said material with alkali at a temperature above about 140° C. to delignify the lignocellulose and form pulp.

9 Claims, 3 Drawing Figures

PULPING OF LIGNOCELLULOSIC MATERIAL BY SEQUENTIAL TREATMENT THEREOF WITH NITRIC OXIDE AND OXYGEN

RELATED APPLICATIONS

This application is a continuation-in-part of applicant's copending application, Ser. No. 385,878, filed Aug. 6, 1973, now abandoned, entitled "Nitric Acid Pulping, and Bleaching", in turn a continuation-in-part of applicant's prior application, Ser. No. 149,589, filed June 3, 1971, now abandoned, entitled "Nitric Acid Pulping and Bleaching".

BACKGROUND OF THE INVENTION

Present pulping operations of the kraft and sulfite types have a number of disadvantages. For example, both processes require equipment which is costly to fabricate and maintain. In the kraft process, the yield of pulp is relatively low due to the severe attack on the hemi-celluloses, in particular. Further, because of the nature of the requirements of the furnace used in the kraft process for recovering inorganic chemicals and fuel values from the various wash streams which contain solubilized wood solids, units of an extremely large capacity must be used to make the operation economically feasible. Sulfite pulping processes also suffer from poor recovery of processing chemicals and of heat values from the dissolved organic acid components washed from the lignocellulose. In both the kraft and sulfite methods, the necessary use of sulfur-containing processing chemicals vastly complicates these recovery operations because of corrosion problems, while also giving rise to the production of malodorous products in the several pulping, washing and chemical recovery steps, particularly in the case of the kraft process.

OBJECTS OF THE INVENTION

It is an object of this invention to provide a higher yield pulping process than typical of current commercial alkaline pulping processes, which can be conducted in an initial reaction at atmospheric pressures and at relatively low temperatures. Operations of this character do not require the use of high pressure steam and they permit the use of relatively inexpensive metals of construction, such as type 305 stainless steel, or acid-resistant ceramics rather than the more expensive steels such as those of the 316 type required in kraft and sulfite processing.

Another object is to substantially reduce the time required in the delignification reactions which are carried out herein under typical temperatures and pressures presently employed in commercial alkaline pulping procedures.

A further object is to eliminate sulfur in the pulping liquor thereby substantially reducing corrosivity of liquors to pulping, washing and recovery systems, and permitting the use of lower cost metals in fabrication of equipment.

A still further object is to provide a pulping process of the foregoing character wherein the production of malodorous products is essentially eliminated, and wherein processing chemicals and heating values can be economically and efficiently recovered from wash streams containing dissolved solids even when operating a plant of relatively modest capacity.

Bleaching of pulps is conventionally practiced in multistage processes involving the use of chloride, hypochlorite, peroxides and/or chlorine dioxide, together with various intervening steps of extraction with alakli. A "stage" may be defined as that phase of the bleaching procedure starting with the addition of chemical, including the reaction of the chemical, and concluding with the washing of the pulp in preparation for the next stage, if any. In conventional bleaching sequences the first stage involves the addition of chlorine to a pulp at low consistency, followed by a stage of extraction with alkali. The respective acidic and basic wash liquors which are obtained from a practice of these stages contain a major portion of the inorganic materials used in bleaching as well as a major portion of the organic compounds dissolves in bleaching and in the form of various derivative compounds. Moreover, these liquors also contain appreciable amounts of chlorine compounds the presence of which, due to corrosivity factors, make it impractical to process the liquors in conventional recovery systems for chemicals and heat values therein. Instead, these streams are sent to the sewer where, being high in BOD, and color they must be given extensive treatment before being released to the environment.

It is another object of this invention to provide pulp bleaching procedures which, though productive of pulps of desired brightness and other physical characteristics, are characterized by the production of wash liquors from at least the first two stages of the bleaching procedure which contain a high percentage of the lignin present in the pulp but are substantially free of chlorine and compounds of chlorine.

A further object is to provide substantially chlorine-free liquors of this character which lend themselves to ready processing for the recovery of the chemicals and heat values contained therein rather than having to be sent to sewerage as highly polluting streams.

The nature of still other objects of the invention will be apparent from a consideration of the descriptive portion to follow, and accompanying drawings, in which:

DETAILED DESCRIPTION OF THE INVENTION

Figure 1:
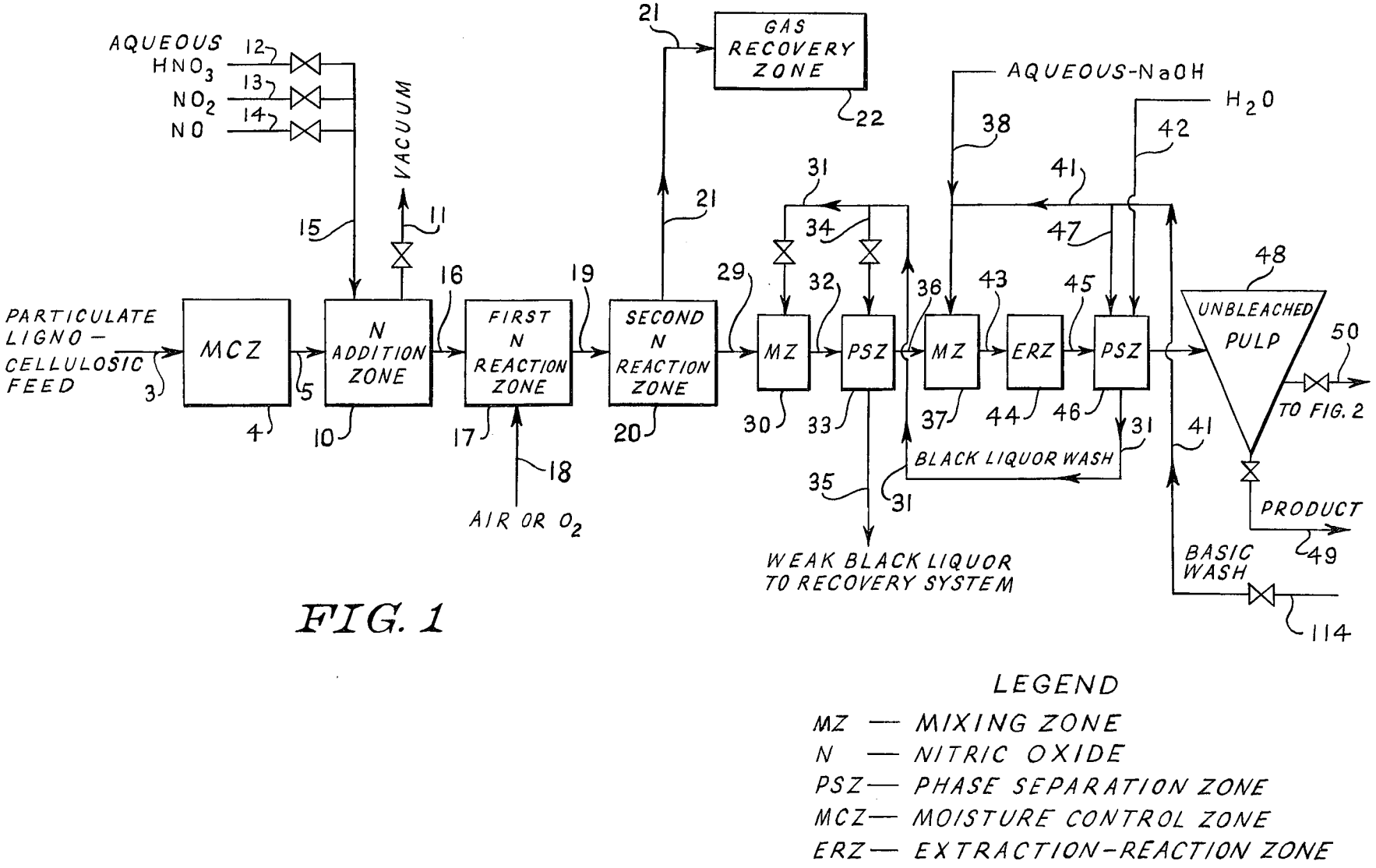
FIG. 1 is a schematic flow diagram of an operation, which embodies the present invention, wherein discrete particles or in other words particulate lignocellulosic material are reacted with nitric acid and whereby the resulting particulate material is subjected to countercurrent washing and base extraction to provide an unbleached pulp which can be further delignified and bleached.

The foregoing and other objects of this invention can be fully achieved by the provision of a pulping stage wherein a substantial portion of the lignin in the discrete particles of lignocellulosic material is freed, a bleaching stage wherein the material is further delignified, and also bleached, or sequential pulping and bleaching stages. The pulping involves the use of nitric acid (either as such or formed by reaction of nitric oxides ($NO_x$) with water) followed by a procedure wherein said reacted material is then subjected to extraction of solubilized material in an alkaline medium. The resulting extracted material may then be subjected to further bleaching with conventional chemicals such as oxygen, chlorine, hypochlorite, chlorine dioxide or peroxides and appropriate extraction stages. The bleaching procedure hereof is also adapted to be employed with a wide variety of pulps as now commercially available.

For convenience of description, the respective pulping and bleaching operations of the present invention will be separately discussed below. Thereafter, the invention will be set forth in its unit process aspects as is described in connection with the flow diagram schematically presented in the drawings.

THE PULPING PROCESS

It has been discovered that a wide range of pulp grades can be produced in good yield from a wide variety of particulate (discrete particles such as wood chips or shavings, bagasse or grasses) lignocellulosic materials by the practice of a process which involves the reaction of said materials with nitric acid at a temperature below about 50° C. and desirably below about 40° C., a suitable range being between about 0° C. and 50° C., in an amount and for a time sufficient to effect consumption of from about 4 to 16 weight percent of nitric acid based on the weight of dry lignocellulosic material (oven dried basis), depending on the particular character of the material and its lignin content. All moisture percentages used hereinafter are on the oven dried basis (O.D.) unless otherwise indicated.

The process hereof is most advantageously conducted with nitric oxide gas (NO) reacted with oxygen in the presence of the moisture, for reasons explained later, the amount of nitric oxide, based on the dry weight of the lignocellulosic material, being about 2 to 8 percent. Based on the amount of lignin percent in the lignocellulosic material, the amount of acid expressed as NO is about 10 to 20 weight percent, and about 20 to 40 weight percent expressed as $HNO_3$. If too much acid is employed, the cellulosic material will become excessively degraded, while too little acid will not effect sufficient reaction of the lignin to facilitate freeing thereof for removal by a subsequent extraction-reaction step with a strong alkali.

As was previously explained, reaction of the material with the acid is carried out in the presence of moisture; and it has been found after extensive testing that the moisture content is critical in obtaining a pulped product with optimum properties. If the treatment is conducted in the presence of too much water, the water serves to inhibit penetration of the acid into the microcapillary structure or voids within the lignocellulosic structure thereby precluding uniform reaction within the material. Also, excess water necessitates the use of more vigorous reaction conditions; and this tends to promote excessive degradation reactions, thereby impairing strength properties.

If the amount of water is insufficient, strength properties are again diminished by excessive degradation of the polysaccharides comprising the pulp fibers. The moisture should be between about 10 to 80 weight percent of the lignocellulosic material on the oven dry basis, and desirably about 20 to 40 weight percent to develop maximum properties. For example, this is about 5 to 30% of the moisture required to completely saturate wood structure before an aqueous phase will separate from wood.

Thus, there is a substantial capillary structure within the particulate material containing a gas phase system. Pentration of this system with nitric oxide and then oxygen permits the formation of oxides of nitrogen, in situ. This provides a uniform distribution of reactants throughout the lignocellulosic structure, and specificity is achieved in reaction with lignin affording minimal usage of reactant and minimal reaction with polysaccharides, thereby producing unexpectedly high physical property of pulps.

In calculating mositure content the moisture content of the lignocellulosic material itself must be taken into account, as well as the water present in nitric acid, if it is used as such. If the lignocellulosic material has too much moisture, it is subjected to a drying step to bring the moisture content within the specified range of 10 to 80% and preferably 20 to 40%. The drying must be effected by conventional means. In some cases and especially may be effected by conventional means. In some cases and especially when dealing with previously desiccated lignocellulosic feed stock, moisture can be introduced into the material prior to the addition of the reactant to facilitate control of its concentration in the material to be treated.

As was previously related, the term "nitric acid", as employed herein and in the appended claims, is intended to include preformed aqueous solutions of $HNO_3$ as well as a complex array of compounds, ions, and radicals (i.e. reactive species) that can be formed therefrom or in situ within the moisture-containing lignocellulosic particles by the addition of gaseous or liquid oxides of nitrogen. This array of oxides of nitrogen includes, for example, nitrogen tetroxide ($N_2O_4$), nitrogen trioxide ($N_2O_3$), nitrogen dioxide ($NO_2$) and nitric oxide (NO), nitrate ions, nitrite ions, nitronium ions, and nitrosonium ions.

When employing nitric oxide, the system must also be supplied at one stage or another with gaseous oxygen in at least the amount of stoichiometrically required to convert the nitric oxide to nitrogen dioxide. Oxygen can also be supplied along with a nitrogen dioxide - nitrogen tetroxide system if desired. Further, even when using preformed nitric acid, it is also possible to supply the lignocellulosic - $HNO_3$ system with an oxygen-containing gas during the period in which reaction is taking place, thereby converting NO formed during the process back to $NO_2$. The latter reacts with water present in the system to form $HNO_3$ and thus improves the efficiency of the process. In speaking herein of "oxygen" gas, it is meant to include not only pure or relatively pure oxygen streams, but also air or a mixture of any proportions thereof.

The nitric acid to be employed to react with lignocellulosic material can be added to or formed within the particulate lignocellulosic feed materials under subatmospheric, atmospheric, or superatmospheric pressures. However, to enhance penetration of the feed particles by the acid, it is convenient to bring the acid into contact with said particles as the latter are maintained under a partial vacuum. For example, the water vapor pressure of the system at ambient temperatures may be the initial pressure used. Thus, in one preferred embodiment,NO is added to the lignocellulosic particles starting at pressures of about 30 mm Hg. This will occasion a pressure rise in the system. Thereafter, oxygen is added, with an attendant reduction in pressure within the system. The system pressure reaches an equilibrium which depends on factors such as the volume of materials added, temperature, reactions taking place, and the volume of the reactor.

The extent of the reaction which takes place between the lignocellulose and the nitric acid will vary with the amount of $HNO_3$, concentration of the acid, temperature, time of reaction and nature of the lignocellulose material being employed as the feed.

When using nitric acid as such, the concentration of the acid used is adjusted taking the moisture content of the lignocellulose into account to bring the theoretical concentration of the nitric acid within the range indicated previously, preferably in this range above about 35%. As previously noted, it has been found pursuant to this invention that if the nitric acid is formed in situ by the reaction of nitric oxide (NO) gas in the presence of moisture, followed by introduction of oxygen, best results are obtained. This is believed due to the fact that nitric oxide, being a gas, penetrates thoroughly within the lignocellulosic structure. As a result, such structure is penetrated or impregnated with the reactive species of the oxides of nitrogen, as the nitric oxide is converted to nitrogen dioxide in situ by introduction of oxygen in the presence of water. Such reactive species then react selectively with the lignin to produce the degraded structure that is later dissolved on alkaline extraction.

When nitric acid is used, it must first diffuse in the aqueous phase throughout the entire particle from its point of contact. Since its application is made essentially at the temperature of reaction, its concentration in the lignocellulosic material must be at a level to undergo desired reaction with lignin but not to substantially undergo degradative reactions with polysaccharides, such as hydrolysis or oxidation. Since the species reacting with lignin may involve reduction products of $HNO_3$ and formation of these requires time, this time element will tend to be beneficial in providing for the desired uniform distribution of reactants to prevent over reaction in some portions and under reaction in other portions of the lignocellulosic particles.

When nitrogen dioxide is added to the particulate material, it will tend to undergo reaction with water present on the surfaces it first contacts, to form the array of reactive species which undergo reaction with the lignocellulosic substrate. This reaction with water is relatively fast; hence uniformity of diffusion of reactants throughout the particulate material is again inhibited, thereby reducing the specificity of reactions with lignin. When nitric oxide (NO) penetrates the structure and oxygen is then added, the contact of the lignocellulose with resultant reactive species will be more uniform throughout the particle.

The desirable sequential addition of nitric oxide followed by oxygen to lignocellulose in the gaseous phase, under conditions which allow the nitric acid to penetrate the cellular structure in the presence of a desired amount of water, provides for the conditions that allow for selective delignification while retaining a desirable structure of the polysaccharides (both cellulose and the hemicelluloses). The retention of this structure is manifest in their resistence to dissolution on subsequent extraction with alkali under the particular conditions used and also in the improved physical properties of the pulp which can be produced.

In introducing the oxygen after the nitric oxide has been added to the material, the reaction is highly exothermic; and if not carefully controlled, temperatures higher than the limit specified would be reacted which will cause a degradation of the polysaccharides comprising the pulp fiber and, therefore, produce a diminution in pulp properties. Consequently, the oxygen is introduced at a controlled rate with accompanying cooling of the reaction vessel to preclude rise in temperature of above about 50° C. and desirably above about 40° C.

A low temperature of addition (below about 20° C.) will liquify nitrogen dioxide (b.p. 21.4° C.) and although its vapor pressure would be high, would tend to retard diffusion. Moreover, special equipment would normally be required for addition and maintenance of such low temperature.

It is desirable to employ a slight excess of oxygen over the stoichiometric amount required to convert nitric oxide to nitrogen dioxode An amount of about up to 35% in excess of that required for stoichiometric reaction with the nitric oxide added is suitable but larger excesses are unnecessary and are undesirable because of time and cost.

The reaction time, after a minimum time, has only minor effect upon the properties of pulps prepared, and in a given operation would be optimized to give the best overall result. Thus tensile properties of resultant pulp appear to increase in a range from about 2 hours to 24 hours; whereas tear properties appear to decrease. It is important that the reaction time be sufficient to substantially effect the consumption of nitric acid noted previously. With treatment of nitric oxides it is substantially complete in 8 hours at about 30° C. and may be as long as 24 hours. Under the same conditions at 20° C. or 40° C., for example, the reaction time will be respectively shorter or longer.

The reaction with nitric acid under the conditions specified effects delignification of as much as 80% of the lignin present in the original raw material. The thus treated material is extracted and reacted with a strong base and then washed, thereby removing substantially all of the solubilized material from the lignocellulose. Pursuant to this invention it has been found important that the base be a strong alkali such as sodium hydroxide, and that the extraction therewith be conducted at a relatively high temperature, advantageously between 160° C. and 180° C., and desirably at a temperature of above 140° C. Such high temperature insures that a maximum amount of lignin is extracted.

In treatment with essentially sodium hydroxide as in soda pulping, a portion of the lignin is condensed (polymerized) at temperatures in excess of 140° C. and solubilization and dissolution of this portion of the lignin is prevented. In treatment with nitric acid as described herein this condensation of lignin is prevented and rate of lignin solubilization is increased throughout the temperature range of 140° to 180° C. Below a temperature of about 140° C. reaction time becomes excessive and as temperature is decreased the selective removal of lignin becomes progressively less complete. Thus the treatment with nitric acid under the conditions used produces a lignin derivative which is not dissolved in strong alkali without accompanying reaction with the alkali to produce a product which can then be dissolved.

The resultant treated material is washed to remove solids present which have been converted to soluble form either by the nitric acid or as a result of the combined nitric acid and base treatments. This base or alkaline extraction is so conducted that the lignocellulosic material is neutralized as well as washed in a countercurrent operation. Upon adding alkali, the system is brought to a pH sufficiently high to dissolve lignin and maintain it in solution. For this purpose sufficient caustic is added to provide a pH of about pH 10 or higher upon completion of the caustic step.

In carrying out such washing operations, the acidic lignocellulosic material can be mixed with a dilute aqueous stream (black liquor wash) of the base material (as recovered from a downstream extraction zone following addition of the base), with the resulting slurry then being passed into a phase separation zone from which there is recovered a solid pulp phase and a spent wash stream which is rich in dissolved solids. This stream, which is free of chlorine containing compounds can readily be processed by conventional methods so as to recover process heat values present therein as well as inorganic chemical constituents.

The solid pulp phase recovered is then mixed with a more concentrated stream of the base, and is thus brought to the desired concentration of caustic, as recited above. When this base extraction stage is completed, which may take from several minutes to one or more hours at 140° to 180° C., the slurry is passed to a second phase separation zone. Here the washed pulp is recovered as the solid phase, while the dilute basic stream referred to above, which is also rich in dissolved solids, is recycled to the first mixing zone for contact therein with the acidic lignocellulosic material as aforesaid.

During or at the conclusion of the base extraction stage, the pulp can be processed, if desired, so as to fiberize the pulp before it is sent to ensuing delignification and bleaching stages of the present invention, or it may be used as an unbleached pulp.

The procedure thus far described is effective in pulping including delignification of previously unpulped particulate lignocellulosic materials which may be obtained from a wide variety of available sources. For example, suitable materials are wood chips, small pieces of unbarked wood, tree trimmings, wood shavings, sawdust, ground up brush, grasses, straws and various plant fibers including wheat and rice straw, corn stocks, bagasse, and secondary fibers of any grade including those derived from newsprint or from the classification of municipal solid waste. The size of the lignocellulosic particles employed is not critical, and may range for example from finely divided shredded material to those of the size of wood chips.

One pulping cycle or pass (nitric acid reaction followed by alkaline extraction-reaction) may be employed which will produce an unbleached (non-white) pulp suitable for many purposes such as linerboard, brown paper bags, wrapping paper, corrugating medium, etc. If white paper is to be made such as writing paper, magazine paper, copy paper and tissue, the pulp resulting from the first cycle may be further delignified in a second cycle and then bleached to increase brightness. In such second cycle or pass of delignification, the product resulting from the first cycle (namely the unbleached pulp) is further delignified in essentially the same manner as in the first cycle except for moisture content of the lignocellulosic material in the nitric acid treating stage, and the temperature used in the alkaline extraction stage for reasons to be explained later.

The pulp from the first cycle is alkaline. Therefore before running it through the second cycle, it is acidified prior to the nitric acid treatment to bring its pH below 2 so as to conserve usage of nitric acid in the pulping stage, although this acidification is not critical. Then moisture is expressed from the acidified pulp, thereby increasing its consistency. It is not practical by expression alone to bring the moisture content of the pulp within the 20 to 40% range described previously for the unpulped raw material treated in the first cycle, as drying would also be required.

However, as a major amount of the lignin is removed in the first cycle, the residual lignin can be removed in the second cycle more readily. Accordingly, the consistency of the stock from the first cycle may be increased to a sufficient level by filtering and then pressing, or mechanically centrifuging. A suitable consistency is at least about 35% and preferably about 50%.

As most of the lignin has been removed in the first cycle, treatment with either nitric acid or alkali in further delignification of the pulp should be conducted under mildest possible conditions in order to retain structure and properties of polysaccharide with minimum degradation. Thus, neither amount of nitric acid used in the acid treating stages nor temperatures used in the alkaline extraction stage of a second cycle need be as high as in the first cycle. A suitable usage of nitric acid expressed as NO, is from 1 to 5 percent by weight of O.D. pulp and a suitable temperature for alkaline extraction is below about 130° C; a suitable range being about 70° to 130° C. for up to 2 hours.

Instead of using pulp from the first cycle, a process alternative is to use partially delignified pulp from another process, such as kraft or sulfite, and treat it in the same way as described for the second cycle.

Instead of using a second cycle as described, the pulp from the first cycle may be treated to express water therefrom as already explained, and oxygen bleaching followed by conventional bleaching, may be employed. Conditions of the oxygen bleaching step are conventional. Following the oxygen bleaching stage a chlorination stage may be employed in which by virtue of the efficacious delignification resulting from the first cycle and oxygen bleaching, the amount of chlorine is materially reduced from that which is normally required in a chlorine bleaching stage; for example from about 8 to 10% of active chlorine required for a hard bleaching coniferous pulp, to about 1 to 2% (O.D. unbleached pulp basis).

The invention will be more clearly understood by reference to the figures of the appended drawings in which various of the valves, pumps, compressors, heating or cooling devices and instruments for controlling temperature, pressure and the like have been omitted, the nature and arrangement thereof being obvious to those skilled in the pulping and bleaching arts in the light of the present description.

Referring more particularly to FIG. 1, a particulate lignocellulosic feed is passed through conduit 3 into a moisture control zone 4 and then conduit 5 into a first acid addition zone 10. In this zone, the desired amount of $HNO_3$ can be added to the feed material under slight pressure or under subatmospheric pressure if the zone is evacuated through line 11. Shown at 15 is a manifold line adapted to receive one or more of a variety of gaseous or liquid treating materials and to discharge the same into zone 10. Thus, the advantageous gaseous NO may be supplied through line 14. Alternatively $NO_2$ as another nitric acid forming gas may be supplied through line 13. If aqueous nitric acid per se is used, it can be supplied through line 12. As was previously described, nitric oxide (NO) produces superior quality pulp. Hence it will be referred to in the following description.

If the lignocellulosic material in zone 10 is treated under reduced pressures, the desired evacuation through line 11 is established, after which this line is closed off and the nitric oxide gas from line 14 is then allowed to flow into zone 10. The pressure in the latter is thereby increased and may be brought to atmospheric or superatmospheric levels depending upon the original pressure and amount of reactant added in a given gas space.

After the desired amount of reactant has been added to zone 10, the manifold line 15 is shut off, and a period of time is allowed for distribution of the reactant within the lignocellulosic particles. Any gases present in said zone not taken up by the lignocellulosic material or which are formed therein, are discharged through conduit 16 with the lignocellulosic material into the first reaction zone 17. Gaseous oxygen in air is then monitored through line 18 into said zone 17 in an amount to supply a slight stoichiometric excess of oxygen for conversion of nitric oxide added to form nitrogen dioxide. Rate of oxygen addition and cooling provided (not shown) are regulated to maintain temperature below the aforementioned critical limit of about 50° C.

When the exothermic reaction occurring in zone 17 is completed, with cooling if required, the treated lignocellulosic material is passed through conduit 19 into a second reaction zone 20 which is adapted to be regulated in temperature and pressure by appropriate means, not shown. Processed gas present in zone 20 can be removed when reaction is substantially complete, by opening line 21 which allows the gas to pass into a gas treatment zone 22. Reactions of nitric oxide and higher oxides of nitrogen are preferably carried virtually to completion with the lignocellulosic material so that only trace amounts of these components are present in gases removed from zone 20. Procedures carried out in addition zone 10 and reaction zones 17 and 20 may also be accomplished in a batch fashion, for example in a single vessel.

After the desired reactions have taken place in zone 20, the treated lignocellulosic material therein is conveyed through conduit 29 into a mixing zone 30 where said material is admixed with a black liquor (alkaline) wash supplied through line 31, said stream being recovered from a downstream phase separation zone 46 described below. The lignocellulosic-liquid mixture slurry from zone 30 is then carried through conduit 32 into a phase separation zone 33 where it is washed with a further quantity of said wash stream, as supplied through line 34. From zone 33, there are recovered a solid phase and a weak black liquor stream which is to be subsequently concentrated. The latter is rich in dissolved solids, and is taken to product recovery (heat and chemicals) through line 35.

Figures 2, 3:
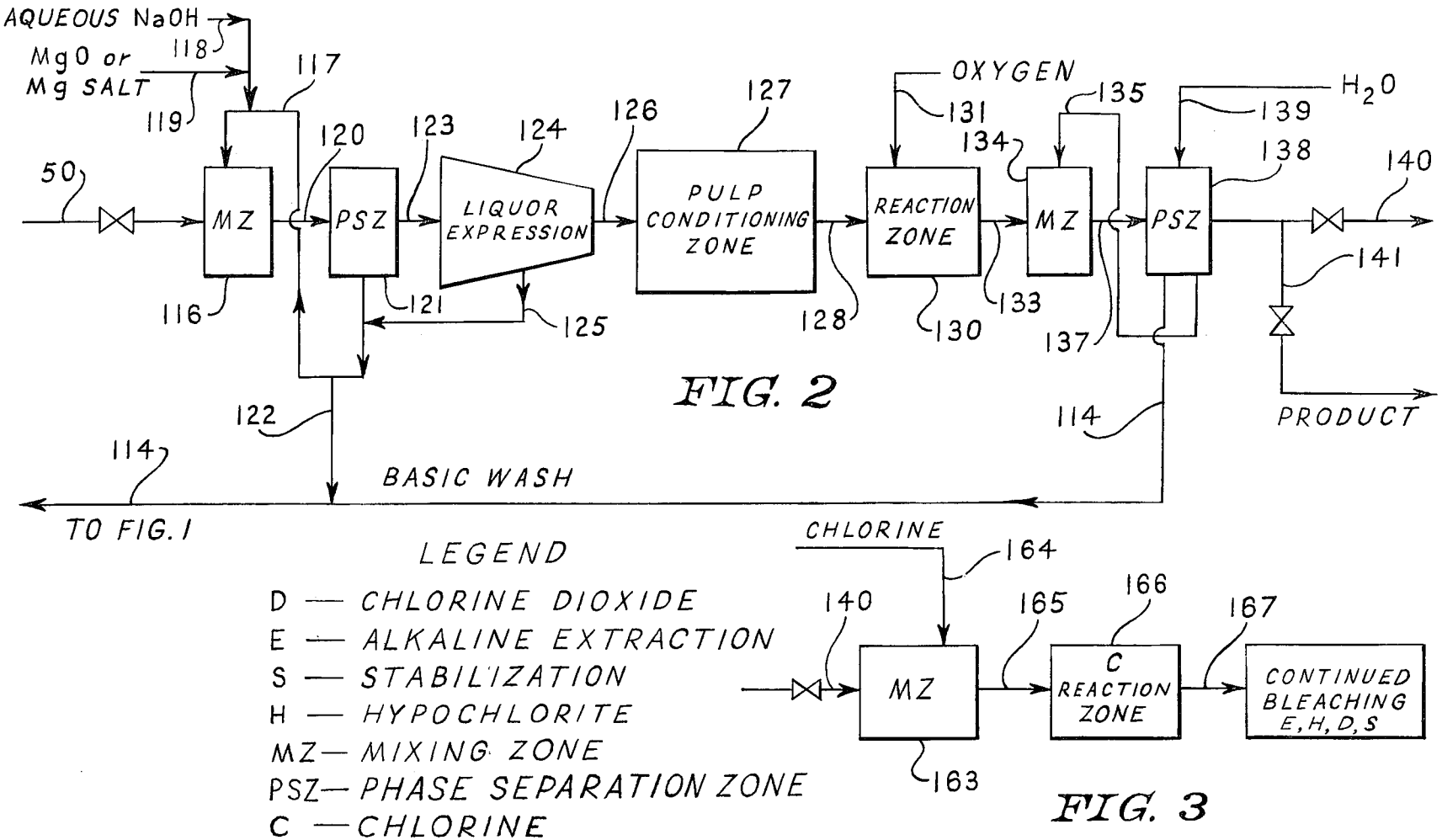
FIG. 2 is a schematic flow diagram which continues from that of FIG. 1 and shows a succession of steps wherein nitric acid-treated and base-extracted pulp is first prepared for bleaching and is then subjected to a bleaching stage using oxygen.
FIG. 3 is a flow diagram continuing from that of FIG. 2 wherein the pulp is first bleached with chlorine and is then given a succession of bleaching and base extraction stages, with the nature of the bleaching agents employed therein depending on the desired brightness of the final pulp product.

The solid phase from zone 33 is carried through conduit 36 into a mixing zone 37 where said phase is admixed with an aqueous solution of a strong base as introduced through line 38, said solution optionally containing a basic wash stream, supplied through lines 41 and 114 as recovered either from a similar downstream alkaline extraction stage of a second cycle previously described, or from a similar stage 138 shown in FIG. 2 of an oxygen bleaching option to be described. While not shown, a portion of the liquid in line 31 can be recycled to zone 37. The alkaline solution in line 38 will normally be made up of caustic soda (NaOH) in an amount sufficient to effect the desired level of delignification in the ensuing extraction-reaction zone 44.

From zone 37 the alkaline slurry passes via conduit 43 to said extraction-reaction zone 44 where it is heated to the aforementioned critical temperature of 140° to 180° C., and held for a length of time sufficient to permit the desired reactions and extractions of the lignin to occur. This may vary widely as to time. At a temperature of 140° C., the time may be 6 to 24 hours. At a temperature of 180° C., the time is usually about ¼ to 1 hour. From extraction-reaction zone 44, the reacted slurry product is then discharged through conduit 45 into phase separation zone 46, referred to above, from which there is recovered the black liquor stream in line 31.

Phase separation zone 46 may be a counter-current washing system where an unbleached product is produced or it may be a step in a counter-current washing system in connection with FIG. 2, as described below. The solid phase recovered from zone 46 is carried into a receiving vessel 48, such solid phase being a partially but substantially delignified, unbleached pulp. The product is discharged through line 49, and as previously related is satisfactory for unbleached products. If the pulp is to be further delignified (i.e. bleached), it may be fed through conduit 50 into the sequence of treating stages, for further delignification and bleaching, for example through the previously described second cycle or as presented in subsequent FIGS. 2 and 3.

If pulp is not taken as an unbleached product through line 49, then it may be conducted through conduit 50 into zone 116 of an oxygen bleaching stage shown in FIG. 2. In this zone the pulp is admixed with an alkaline stream supplied through line 117. Make-up chemicals conventional in oxygen bleaching, including sodium hydroxide and magnesium oxide or an appropriate magnesium salt, are added to line 117 from lines 118 and 119. The pulp passes via conduit 120 into phase separation zone 121. From this zone there is recovered a basic wash stream, taken off through line 117, which is returned to zone 116 along with the expressed liquor from the succeeding liquor expression zone 124 to which the pulp is passed through conduit 123. In expression zone 124 the consistency of the pulp is raised to a level of about 15 to 30 percent which is lower than the aforementioned consistency when a second cycle is used because bleaching with oxygen is more efficient at a lower consistency.

The dewatered pulp is now passed through conduit 126 into conditioning zone 127 where the pulp is fluffed, following which it is passed through conduit 128 into reaction zone 130 where it is treated with oxygen supplied through line 131 at superatmospheric oxygen partial pressures. Following reaction with oxygen, the pulp is passed through conduit 133 into mixing zone 134 wherein the pulp is mixed with an aqueous stream as supplied through line 135. The resulting slurry passes through conduit 137 into a phase separation zone 138 where the pulp is further washed with water supplied through line 139. The basic stream 114, referred to above, is recovered from this zone 138. At this point in the operation, a substantially completely delignified pulp product can be taken through lines 140 and 141 when higher brightness is not desired.

Turning to the embodiment of the invention shown in FIG. 3, there are presented alternative bleaching sequences wherein the oxygen bleached, alkaline pulp slurry from phase separation zone 138 of FIG. 2, or a like unit from the second cycle treatment, previously discussed, is passed through conduit 140 to a zone 163 where the pulp is admixed with chlorine, the latter being supplied through line 164 under conventional bleaching conditions. This is followed by a step wherein the resulting pulp is carried through conduit 165 into a reaction zone 166 where the pulp remains until the bleaching afforded by the chlorine is completed. When using a second cycle previously discussed, the chlorination step already described in zones 163 and 166 is advantageous for best results.

The partially bleached pulp from zone 166 (FIG. 3) or directly from zone 138 (FIG. 2) is brought to the desired degree of brightness by the practice of still further conventional bleaching procedures, which can be continued. For example, these may be EHS, EHEHS, EDS, EHD, and EDEDS stages E, H, D and S (FIG. 3) represent, respectively, a caustic extraction, a sodium hypochlorite bleaching, chlorine dioxide bleaching, and final stabilization stages involving treatment with sulfurous acid, or the like. The usual continued bleaching after chlorination is an alkaline extraction stage followed by one or more sodium hypochlorite or chlorine dioxide stages.

The following is a typical example illustrative of the invention.

EXAMPLES

In this operation, 120 parts of conventional white fir chips having a moisture content of 20 weight percent water, on an oven dry weight basis, were placed in a flask which was then exhausted to provide a vacuum of 26 in. Hg. All parts given herein and in the following examples are on a weight basis unless otherwise indicated. To the evacuated flask were then added, with tumbling to assure good contact of chips and gas, 5 parts of gaseous nitric oxide (NO), and on completion of this addition 5 parts of gaseous oxygen were added at a rate such that temperature within the chip mass did not exceed 40° C. Such temperature was maintained by appropriate cooling; i.e., by use of a cold water bath. On completion of the addition of oxygen, the system was held for a total of 24 hours at which time the chips were slurried and washed in 800 parts of a solution containing 25 parts of sodium carbonate (equivalent to black liquor). The mixture was then heated to 80° C., held at this temperature for 1 hour, and the particulate material was separated from the free solution. Thereby, acidic moieties were neutralized, and extraction of solubilized components was initiated.

The neutralized material was placed in a pressure vessel, and 300 parts of a caustic solution containing 20.6 parts of NaOH were added. The solution formed was circulated through the resulting mass of particulate material to maintain contact of liquor with said material; temperature within the pressure vessel was brought to 180° C. over a period of 1 hour and was then held at that level for 0.5 hours. The temperature of the material was then rapidly reduced to below the boiling point of the solution in contact with the material at normal atmospheric pressure. The thus treated chips were agitated in an aqueous slurry using a mechanical mixer, washed to substantially remove dissolved material, and then screened on a 12 cut flat screen.

There thus was obtained 48.4 parts of screened pulp and 0.3 parts of reject, both on a dry weight basis. The screened pulp was characterized by a conventional Kappa number of 43 and a 72% sulfuric acid insoluble lignin content of 3.2% on an O.D. pulp basis. Reject material obtained in screening constitutes that material which has not been delignified to the extent that all of the cells of a particulate are separated but a sufficient number remain intact so that the resulting particle will not pass through the screen used. These bundles of cells are also referred to as shives.

Using the procedure given in Example 1 on the same chip supply and changing only those conditions tabulated in Table I below, gave results which illustrate the equivalence of certain combinations of variables as well as the flexibility of the invention for producing pulps exhibiting different degrees of delignification, and, consequently, different grades of pulps that may be used to produce products for a variety of end uses. These examples are illustrative only and are not intended, in any way, to be optimum for or to limit the variability that may be used in producing pulp for any given end use.

TABLE I

Yields, Kappa Numbers and Lignin Contents of Pulps Prepared Under Varying Conditions.

| | NO then $O_2$ Stage | | | Alkaline Extraction-Reaction Stage | | | |
|---|---|---|---|---|---|---|---|
| Example Number | NO parts | $O_2$ parts | time hrs. | Temp ° C | Time (hrs.) | as NaOH parts | as $Na_2O$ parts |
| 1 | 5 | 5 | 24 | 180 | 0.5 | 20.6 | 16 |
| 2 | 5 | 5 | 24 | 180 | 0.25 | 20.6 | 16 |
| 3 | 5 | 5 | 24 | 160 | 4.0 | 20.6 | 16 |
| 4 | 5 | 5 | 24 | 160 | 4.0 | 15.5 | 12 |
| 5 | 5 | 5 | 24 | 160 | 4.0 | 12.0 | 9.3 |
| 6 | 5 | 5 | 24 | 140 | 16.0 | 20.6 | 16 |
| 7 | 5 | 5 | 24 | 140 | 24.0 | 20.6 | 16 |
| 8 | 3 | 3 | 8 | 160 | 4.0 | 20.6 | 16 |

| | Yields | | Screened Pulp | |
|---|---|---|---|---|
| Example Number | Total % | Shives % | Kappa No.[1] % | Lignin[2] % |
| 1 | 48.7 | 0.3 | 43 | 3.2 |
| 2 | 53.3 | 1.0 | 65 | 5.3 |
| 3 | 50.2 | 0.4 | 44 | 3.3 |
| 4 | 56.7 | 4.2 | 80 | 6.9 |
| 5 | 65.1 | 36.4 | 117 | 11.6 |
| 6 | 54.7 | 1.3 | 70 | 5.9 |
| 7.51.9 | .2 | 61 | 4.8 | |
| 8 | 52.9 | 0.3 | 81 | 6.6 |

[1]Kappa number is a measure of the amount of lignin left in the pulp and, therefore, the efficiency of pulping and the bleachability of the pulp. Thus, the lower the Kappa number the better the pulp. A Kappa number below 45 may be considered as a bleachable-grade pulp.
[2]Lignin % is based upon O.D. pulp isolated.

Physical properties of the pulps produced in above Examples 1, 2, 3 and 7 are compared to those of a standard Kraft pulp made from the same chip supply, as shown in the following Table II.

TABLE II

| Pulp of Example | Property | Value of Property at Canadian Standard Freeness (in ml.) 600 | 500 | 400 |
|---|---|---|---|---|
| 1 | Breaking Length (BL) (kilometers) | 12.0 | 12.4 | 12.3 |
| | Burst Factor (BF) (TAPPI Standard) | 87.5 | 90.5 | 93.0 |
| | Tear Factor (TF) (TAPPI Standard) | 120 | 111 | 104 |
| 2 | BL | 10.7 | 11.2 | 11.4 |
| | BF | 78 | 80 | 81 |
| | TF | 110 | 103 | 98 |
| 3 | BL | 11.9 | 12.3 | 12.5 |
| | BF | 80 | 84 | 87 |
| | TF | 111 | 105 | 100 |
| 7 | BL | 10.4 | 10.9 | 11.2 |
| | BF | 72 | 76 | 78 |
| | TF | 101 | 94 | 90 |
| Kraft | BL | 11.8 | 12.2 | 12.6 |

TABLE II-continued

| Pulp of Example | Property | Value of Property at Canadian Standard Freeness (in ml.) 600 | 500 | 400 |
|---|---|---|---|---|
| | BF | 92 | 94 | 95 |
| | TF | 126 | 115 | 111 |

It will be noted that the pulp of Example I exhibited properties essentially equal to those of Kraft pulp.

The Kraft pulp given in Table II was prepared using conditions shown in Table I which were as follows: active alkali (expressed as $Na_2O$), 16%; sulfidity, 25%; liquor-to-wood ratio, 5:1, one hour to bring temperature to 160° C. and 3.75 hours at 160° C. The same stationary digester was used in carrying out Kraft pulping that was used in carrying out the extraction-reaction stage and the same procedures were used in bringing to temperature, holding at temperature, and reducing temperature at the end of the pulping reaction. Total and shive yields obtained in the Kraft reaction were 48.6% and 0.1%, respectively. The screened pulp gave a Kappa No. of 81 and a lignin content of 6.6%.

In Example 2, conditions were the same as in Example 1 except that the time used in the alkaline extraction-reaction stage was reduced to 0.25 hours, giving the attendant increases in yields, Kappa number and lignin content shown. Properties of the pulp prepared though somewhat lower than in Example 1 were still very good, as shown in Table II.

In Example 3, in which the alkaline extraction-reaction temperature was decreased to 160° C. and time was increased to 4.0 hours a total yield increase of 1.5% was obtained at essentially the same Kappa number and lignin content as that obtained in Example 1. Properties of the pulp were also excellent and similar to those obtained in Example 1, as shown in Table II.

In Example 4, conditions identical to those of Example 3 were used except the amount of NaOH was decreased to 15.5 parts. A substantial increase in total yield was accompanied by an increase in shives, Kappa number, and lignin content. Similarly, in Example 5, the amount of NaOH used was further decreased to 12 parts with still further increases in total yield, shives, Kappa number, and lignin content.

Based upon yield and properties of these pulps, those given in Examples 1 and 3 are considered as bleachable grades using conventional bleaching sequences. The pulp given in Example 2 is considered for use where full-chemical, unbleached pulps are used. Similarly, the pulp given in Example 4, or a pulp prepared using an amount of sodium hydroxide that is intermediate between that used in Examples 3 and 4 are considered where full chemical, unbleached pulps are used.

In Example 5 a pulp was prepared in the range typical of high yield pulps and is suitable for uses typical for high yield pulps or for further processing either by oxygen bleaching according to FIG. 2 or by a second cycle as described herein.

Example 6 shows the effects of lowering the alkaline extraction temperature to 140° C. and increasing time to 16 hours using 20.6 parts NaOH. The total yield, shive yield, Kappa number and lignin content were all increased and pulp properties were decreased compared to results obtained in Examples 1 and 2 at 180° C., and 3 at 160° C. in which 20.6 parts NaOH were used.

When time was increased to 24 hours at 140° C. in Example 7, the extent of delignification was less complete than in Examples 1 to 3 and properties of the pulp produced though still high, as shown in Table II, were lower than for either Examples 1 or 3 which were carried out at 180° C. and 160° C., respectively. This was also true for Example 2 carried out at 180° C. in higher yield than obtained in Example 7. Thus the desirable range for the alkaline extraction-reaction stage from 160° to 180° C. is demonstrated.

In Example 8 the amount of NO and $O_2$ and the time of reaction used in the nitric oxide-oxygen addition stage were reduced. This gave a greater total yield of pulp than obtained in Example 3 under otherwise comparable conditions; however, the extent of delignification was lower as shown by the higher Kappa number and lignin content of the pulp obtained in Example 8. Properties of the pulp obtained were also inferior. Accordingly, overall results using 5 parts NO were superior to those obtained using 3 parts NO. Conditions used in Example 7, employing a decreased amount of NaOH in the extraction-reaction stage, may be followed by an oxygen bleaching stage such as that given in FIG. 2 or by a second cycle using nitric oxide and oxygen as described herein.

I claim:

1. A process of preparing high strength pulp from particles of lignocellulosic material having a capillary structure which comprises treating said material with 2 to 8% nitric oxide, based on the dry weight of said material, and then reacting said nitric oxide treated material with molecular oxygen to form nitric acid in situ, said reaction being carried out at a temperature below 40° C for a time sufficient to substantially effect consumption of nitric acid and at a moisture content of 10 to 80% of the lignocellulosic material, the nitric oxide being added sufficiently prior to the oxygen to effect substantially thorough penetration of the material with the nitric oxide before reaction occurs with the oxygen, washing the nitric acid treated material with an alkaline solution and delignifying the washed material by extracting the washed material with a strong alkali at a temperature above about 140° C resulting in a cellulosic pulp.

2. The process of claim 1 wherein the alkaline solution used to wash the material is black liquor which neutralizes acid and initiates dissolving of the freed lignin, and the extraction with the strong alkali is at a temperature of about 140° to 180° C.

3. The process of claim 1 wherein after extraction with the strong alkali the cellulosic pulp has liquid expressed therefrom to bring the consistency of the pulp to at least about 35% and is then treated with nitric acid at a temperature of below about 40° C, with the amount of nitric acid being about 1 to 5 percent by weight of said pulp expressed as nitric oxide, washed with an alkaline solution and then extracted with a strong alkali at a temperature below about 130° C.

4. The process of claim 1 wherein the cellulosic pulp is bleached with oxygen in an alkaline medium.

5. The process of claim 4 wherein the oxygen bleaching is followed by treatment of said cellulosic pulp with chlorine.

6. The process of claim 5 wherein the amount of chlorine is about 1 to 2% by weight of the pulped material on the dry basis thereof.

7. The process of preparing high strength pulp from particles of lignocellulosic material having a capillary structure which comprises treating the material at a moisture content of at least about 10% and below about 80% based on the dry weight of the material, with nitric oxide and oxygen gas which react with moisture present in the material to form nitric acid in situ, the nitric oxide being added prior to the oxygen to effect substantially thorough penetration of the material with the nitric oxide before reaction occurs with the oxygen, the amount of nitric oxide being about 2 to 8 percent based on the dry weight of said material, the amount of oxygen being at least sufficient to convert substantially all nitric oxide to nitrogen dioxide, controlling the rate of addition of the oxygen to the material to preclude excessive rise in temperature above about 50° C and thereby preclude excessive degradation of cellulosic fibers in the material, washing the nitric acid treated material substantially free of acid, and delignifying the washed material by removing freed lignin therefrom by extracting said washed material with a strong alkali at a temperature above about 140° C resulting in a cellulosic pulp.

8. The process of claim 7 wherein the nitric oxide is added to the material under vacuum or pressure to enhance penetration of the nitric oxide into the material, and the alkali extraction is performed at a temperature of about 140° to 180° C.

9. The process of claim 7 wherein the washing of the nitric acid treated material substantially free of acid is performed with black liquor to neutralize acidic components and to initiate dissolving of the freed lignin, and the cellulosic pulp resulting from extraction with strong alkali at about 140° C has liquid expressed therefrom to bring the consistency of the pulp to at least about 35% and is then treated with nitric acid at a temperature of below about 40° C, with the amount of nitric acid being about 1 to 5 percent by weight of said pulp expressed as nitric oxide, washed with an alkaline solution and then extracted with a strong alkali at a temperature below about 130° C.

* * * * *